US006780094B2

(12) United States Patent
Walker

(10) Patent No.: US 6,780,094 B2
(45) Date of Patent: Aug. 24, 2004

(54) OSCILLATING HAND TOOL

(75) Inventor: Andrew Walker, Newton Hall (GB)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 10/194,543

(22) Filed: Jul. 12, 2002

(65) Prior Publication Data

US 2003/0017795 A1 Jan. 23, 2003

(30) Foreign Application Priority Data

Jul. 20, 2001 (GB) ..... 0117670

(51) Int. Cl.[7] ..... B24B 23/00
(52) U.S. Cl. ..... 451/356; 451/359
(58) Field of Search ..... 451/356, 357, 451/359, 270, 271, 159

(56) References Cited

U.S. PATENT DOCUMENTS 3,862,520 A * 1/1975 Klebe et al. ..... 451/357
4,744,177 A * 5/1988 Braun et al. ..... 451/357
4,754,575 A 7/1988 Schneider ..... 51/120
5,595,531 A * 1/1997 Niemela et al. ..... 451/357
5,807,169 A * 9/1998 Martin et al. ..... 451/357
5,813,903 A * 9/1998 Amano et al. ..... 451/294
6,132,300 A * 10/2000 Martin ..... 451/357
6,503,133 B2 * 1/2003 Wuensch ..... 451/357
6,527,631 B2 * 3/2003 Wuensch et al. ..... 451/357

FOREIGN PATENT DOCUMENTS

| | | |
|---|---|---|
| EP | 0 694 365 | 1/1996 |
| EP | 0 713 751 | 5/1996 |
| GB | 2338 197 | 12/1999 |

* cited by examiner

*Primary Examiner*—Lee D. Wilson
(74) *Attorney, Agent, or Firm*—Harness, Dickey & Pierce, P.L.C.

(57) ABSTRACT

The powered oscillating hand tool is provided having a first drive shaft 7 and a bearing 15 mounted eccentrically relative to the first drive shaft 7. A second drive shaft 14 carries a mounting platen 90 by means of one or more flexible legs 80. The first and second platens are interchangeably mountable on the second drive shaft 14 and a brake means is provided on the mounting platen 90 to restrain the speed of rotation of a selected first or second platen.

22 Claims, 4 Drawing Sheets

OSCILLATING HAND TOOL

The present invention relates to a powered oscillating hand tool, and especially to a powered oscillating hand tool with interchangeable sanding platen attachments.

Powered oscillating hand tools with sander attachments are well known. Known sanders are usually described as either orbital sanders or random orbit sanders, or may combine both facilities in a single hand tool.

Orbital sanders typically comprise a shaped sanding shoe, the drive system of which exhibits an eccentric motion which is restrained so that the sanding shoe can not spin independently of the motor. Therefore in such orbital sanders there is no free rotation of the sanding shoe about its axis. Such orbital sander shoes are generally used for removal of relatively small quantities of material, for example for detailed work or for finishing. Also the shoe may be shaped for access to awkward corners or the like, and may be used for any removal of material in these places.

In contrast, random orbit sander typically comprise a circular platen driven by a drive system which comprises an eccentric bearing so that the platen can spin independently of the motor, and the platen describes a random orbit. Therefore in random orbit sanders, the sanding platen is permitted free rotation about its axis. Such sanders are in general used for the removal of relatively large quantities of material.

EP-A-0694365 describes a single hand tool that is adapted to receive interchangeable sander platens, and perform a dual function: as an orbital sander with a sanding platen secured against free rotation, and as a random orbit sander, with a freely rotating sanding platen. This reference describes a bearing mounted eccentrically on a first drive shaft, and a second drive shaft mounted on the eccentric bearing on which an orbital sander platen and a random orbit sander platen can be interchangeably mounted. A plurality of flexible columns are fitted to the orbital sander platen and these co-operate with rigid components on the housing so that the orbital platen is prevented from free rotation. Alternatively the position of the flexible columns and rigid components can be interchanged. The interchangeable random orbit sanding platen does not have any similar means to couple with the housing and hence is permitted free rotation.

Where freely rotating or random orbit sanding platens are used it is known to mount a brake in the housing so that the brake is in constant contact with the sanding platen. The brake operates in two ways. When the sander is in use, the brake acts as a platen speed limiter, operating in particular to prevent scratches when the unit is placed on and taken off the work surface. Secondly, when the unit is switched off, the stop time is very much reduced.

EP-A-0713751 describes a brake that is particularly suitable for use in the dual function powered oscillating hand tool of the typed described in EP-A-0694365. It describes brake means comprising an abrasion resistant contact layer mounted on a resilient support member in the form of a ring or one or more posts, and formed from resilient material. The brake is located either on the housing part (facing a reaction surface on the random orbit sanding platen) or on the random orbit sanding platen (facing a reaction surface on the housing), and is arranged so that when the random orbit sanding platen is mounted the resilient material is under compression and provides a resultant load on the reaction surface.

We have designed a hand tool with interchangeable first and second sanding platens (the first sanding platen being capable of free rotation, but the second sanding platen being secured against free rotation) in which an intermediate mounting platen is provided secured to the housing, and located between the housing and the sanding platens. The intermediate mounting platen comprises both a brake for the first sanding platen and a coupling means for securing the second platen against free rotation. The hand tool is a modification of the hand tool described in EP-A-0694365, the entire disclosure of which is incorporated herein by reference.

Accordingly the present invention provides a powered oscillating hand tool comprising a housing; a drive unit contained in the housing and having a first drive shaft (7); a bearing (15) mounted on the said first drive shaft (7) which is located radially eccentrically relative to the first drive shaft (7), and which drives a second drive shaft (14); a mounting platen (90) secured to the housing by means of one or more flexible legs (80), and first and second sanding platens interchangeably mountable on the second drive shaft, the first sanding platen being arranged for mounting on the second drive shaft and for free rotation about the second drive shaft, and the second sanding platen being mountable on the second drive shaft but securable against free rotation about the second drive shaft; the mounting platen being provided with (i) brake means for providing braking between the first sanding platen and the secured mounting platen, and (ii) coupling means to couple to the second sanding platen so as to provide the said securement against free rotation of the second sanding platen about the second drive shaft.

The mounting platen of the hand tool of the present invention therefore provides a dual function. It acts as a mounting surface for a braking means for when the first sanding platen (the freely rotating platen) is in place; and it acts as a coupling means to prevent free rotation of the sanding platen when the second sanding platen (the platen secured against free rotation) is in place.

While the first sanding platen is arranged to be mountable on the second drive shaft in such a way that the brake means acts on it, it is also preferably arranged so that neither the mounting platen nor the coupling means on the mounting platen engage it so that it is therefore allowed to rotate freely.

As in the known brakes for hand sander tools, the brake means of the present invention acts in two ways; as a speed limiter, and secondly, when the unit is switched off, to reduce the stop time. The brake acts only to restrain rotation to safe limits, and does not prevent free rotation.

Preferably the brake means is provided on a surface of the mounting platen. For example, it may be a brake pad mounted on the surface of the mounting platen facing the first sanding platen. An especially preferred brake pad comprises an abrasion resistant contact layer mounted on a resilient support member, and the part of the first sanding platen facing the brake pad provides a reaction surface, whereby the resilient material under compression provides a resultant load on the reaction surface. The resilient support member may be in the form of either a ring or one or more posts and be formed from a resilient material. A particularly suitable material for the abrasion resistant contact layer is polytetrafluoroethylene (PTFE) brake material. For increased abrasion resistance, fillers such as carbon powder or glass can be added to the PTFE. Particularly suitable materials for the resilient support member include natural or synthetic rubbers or synthetic foam materials such as polyethylene, polyurethane or PVC-nitrile. Particular embodiments of brake pad that could be used in the present invention are described in EP-A-0713751, the entire disclosure of which is incorporated herein by reference.

The braking means preferably limits the rotational speed of the first platen to an acceptable operating speed, preferably less than 20%, more preferably less than 15%, most preferably about 10% of the rotational speed of the motor. For example, the first driving shaft is typically driven by the motor at a rotational speed of 12000 rpm, which is too fast a speed for safe rotation of the sanding platen, and the brake means limits the operational rotational speed of the first platen to around 1200 rpm, i.e. to 10% of the driving speed.

The mounting platen of the hand tool of the present invention acts not only as a mount for a brake means for the first platen when mounted, but also as a coupling means for coupling to the second platen substantially to prevent free rotation of the second platen. It is able to do this because it is itself secured to the housing by means of one or more flexible legs, whereby rotation between the mounting platen and the housing is substantially prevented. For stability, preferably two or more flexible legs are preferably provided on the mounting platen, especially three, four, or more legs, preferably spaced across the surface of the mounting platen.

The coupling means of the mounting platen may simply comprise the peripheral shape of the mounting platen. This may co-operate with the peripheral shape of the second sanding platen. For example, the second sanding platen may be provided with a lipped edge which fits around the periphery of the mounting platen. The peripheries may be shaped, e.g. non-circular, to enhance the cooperation and prevent relative slipping. Instead of, or in addition to, the coupling means of the mounting platen comprising the peripheral shape of the mounting platen, the coupling means of the mounting platen may comprise a separate part provided on a surface of the mounting platen, co-operating coupling means being provided on the second sanding platen. Where coupling means are provided on a surface of the mounting platen they, and/or the co-operating coupling means on the second sanding platen preferably comprise a shaped part. By "a shaped part" we mean a part shaped distinctly from the surface on which it is located. Where shaped part coupling means are used, a preferred shape for one or more of the coupling means is a right cylindrical projection or recess. Other projecting parts of uniform, but non-circular cross-section are also preferred shaped parts for use as coupling means. Where the coupling means comprises a hollow recess, this may be directly into the surface of the platen (the mounting platen or the second sanding platen), or may be provided in a projecting member projecting from the surface of the platen. Preferably the coupling means on both the mounting platen and the second sanding platen comprise projecting aligned parts, with one of the aligned parts containing a recess into which the co-operating projection fits. The inner co-operating projection is preferably a central pin-shaped member.

The coupling means on the mounting platen may be on any surface of the mounting platen. Preferably the coupling means on the mounting platen is on a different surface of the mounting platen from the flexible legs that extend from the mounting platen to fix it to the housing. Most preferably the coupling means on the mounting platen are on the opposite surface of the mounting platen from the flexible legs.

Preferably two or more separate coupling means are provided on the mounting platen, and these are preferably spaced across the said surface of the mounting platen. Preferably a corresponding number of coupling means are provided on the second sanding platen, preferably correspondingly located spaced apart across the said surface of their respective platens. The coupling means may be uniformly or non uniformly spaced apart across the surface of the mounting platen. An advantage of non uniform spacing is that it means the sanding platen can only engage the coupling means on the mounting platen in one orientation; i.e. there is no risk of the user installing the second sanding platen back to front (if it is a non-uniformly shaped platen designed to be positioned in one orientation only).

In operation, when the second platen is mounted, and the tool is switched on, since the mounting platen is secured to the housing by its flexible leg(s), and the second platen is coupled to the mounting platen, free rotation of the second platen is substantially prevented. The flexibility of the leg(s) however allows the second platen to follow the eccentric motion of the second drive shaft, which therefore oscillates within a fixed orbit.

The coupling means on the mounting platen and second sanding platen are arranged substantially to prevent free rotation of the second sanding platen about the second drive shaft axis. To this end they preferably engage so that the platens are located in substantially parallel planes, and the coupling means substantially prevent relative movement of the platens in the directions parallel to the planes of the platens. The coupling means preferably allow relative movement of the mounting platen and the second sanding platen in other directions, e.g. in the direction perpendicular to the planes of the platens; this movement allowing the orbital sanding platen to be brought onto, or withdrawn from the mounting platen.

Where brake means and coupling means are provided on a surface of the mounting platen, they are preferably provided on the same surface of the mounting platen, preferably on the surface facing the second sanding platen, when mounted.

The combination of the mounting platen and the co-operating second sanding platen is also new, in the absence of the other parts of the tool.

Accordingly a second aspect of the present invention provides a kit of parts for use in a powered oscillating hand tool comprising a housing containing an eccentrically driven drive shaft capable of accepting, interchangeably, first and second sanding platens, the first sanding platen being arranged for mounting on, and for free rotation about, the said drive shaft, and the second sanding platen being secured against free rotation relative to the said drive shaft (and preferably mountable on the second drive shaft); the kit of parts comprising a mounting platen, which in use can be secured to the housing of the tool, and which comprises brake means for acting on the first sanding platen when mounted in use, and coupling means on a surface of the mounting platen for co-operating with the second sanding platen when mounted in use; and the second sanding platen, comprising coupling means for co-operating with the coupling means on the mounting platen, substantially to prevent free rotation of the second platen when mounted on the drive shaft in use.

Embodiments of the present invention will now be described, by way of example, with reference to the accompanying drawings, wherein.

Figure 1:
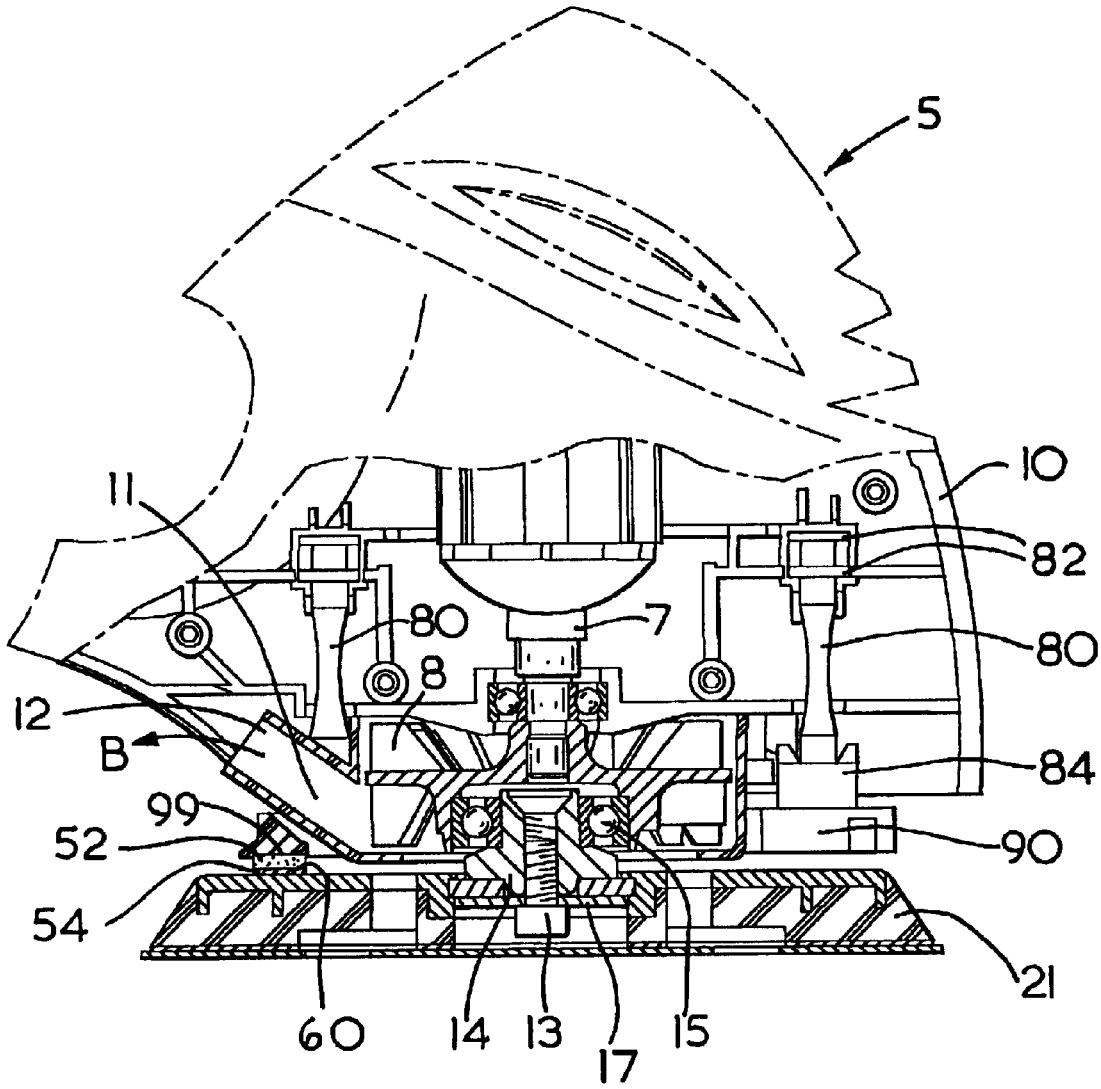
FIG. 1 is a side view, partially in section, of the hand tool according to the present invention, showing the mounting platen of the hand tool with a first sanding platen, which is a random orbit sanding platen, attached.

FIG. 1 shows a drive unit 5 including an electric motor (not shown) and first drive shaft 7. A fan 8 mounted on shaft 7 is arranged to draw air in from mouth 9 of the drive unit 5 as shown by arrow A, and direct it through extractor duct 11 to outlet 12, as shown by arrow B. Bearing 15 is eccentrically located radially in respect to shaft 7, and a second drive shaft 14 rotates about the axis of bearing 15. A mounting platen 90 is fixed to the housing 10 by means of four flexible rubber legs 80. The mounting platen 90 is substantially flat, and the legs 80 extend from a common major surface of the platen 90 (the upper surface as shown in the Figure), directed into the body of the housing 10. The flexible legs 80 extending from the mounting platen 90 are permanently fixed at their housing end to the housing 10, i.e. they are not removable in use by the operator. They are attached to the housing 10 by means of clamping flanges 82 of the housing 5. The flexible legs 80 are attached at their mounting platen end to the mounting platen 90 by passing through apertures in hollow projecting portions 84 that extend in the direction of the flexible legs 80 from the upper surface of the mounting platen 90. The flexible legs 80 are provided at their mounting platen 90 end with an internally screw threaded hollow recess for attachment to a securing screw. The manner in which this securement to the mounting platen is effected is described in more detail below with reference to FIG. 2.

The mounting platen 90 surrounds the second drive shaft 14, and is spaced radially therefrom. This means that the mounting platen 90 itself is not directly driven by either of the drive shafts.

In FIG. 1 a first sanding platen, which is a random orbit sanding head 21, is secured next to the mounting platen 90 onto the drive shaft 14. Securement of the random orbit sanding head 21 is achieved by a bolt 13 and washer 17. The bolt 13 passes through an aperture in the sanding head 21, through aperture 89 in the mounting platen (see FIGS. 3 and 4), and over the driving spindle of the second drive shaft 14. The sanding platen 21 is located in a parallel plane to the mounting platen 90, but is spaced from it, so that there is no contact between the facing surfaces of the mounting platen 90 and the sanding shoe 21. Therefore free rotation of the sanding platen 21 is permitted about the bearing axis 15, and the platen 21 exhibits a random orbit.

A brake pad 99 is provided on the under-surface of the mounting platen 90. The brake pad 99 comprises a resilient member 52 in the form of a ring formed from a synthetic rubber resilient material, and an abrasion resistant contact layer 54 comprising polytetrafluoroethylene (PTFE) filed with carbon fibre or glass for increased abrasion resistance. The arrangement of the layers is such that when the sanding platen 21 is secured in place onto the drive 14 then the resilient ring 52 is under compression so that a resultant load is put by the filled PTFE layer 54 onto a reaction surface part 60 of the underlying upper surface of the sanding platen 21. The purpose of this brake 99 is two-fold: first, in use, the brake acts as a speed limiter, operating in particular to prevent scratches when the unit is placed on and taken off the work surface, and secondly when the unit is switched off, the stop time is very much reduced compared to a non-braked tool. In operation the drive shaft 7 is typically driven at a rotational speed of 12000 rpm, which is too fast a speed for rotation of the sanding platen 21. The brake pad 99 limits the rotational speed of the platen to an acceptable operating speed, typically around 1200 rpm, or 10% of the rotational speed of the motor.

Figure 2:
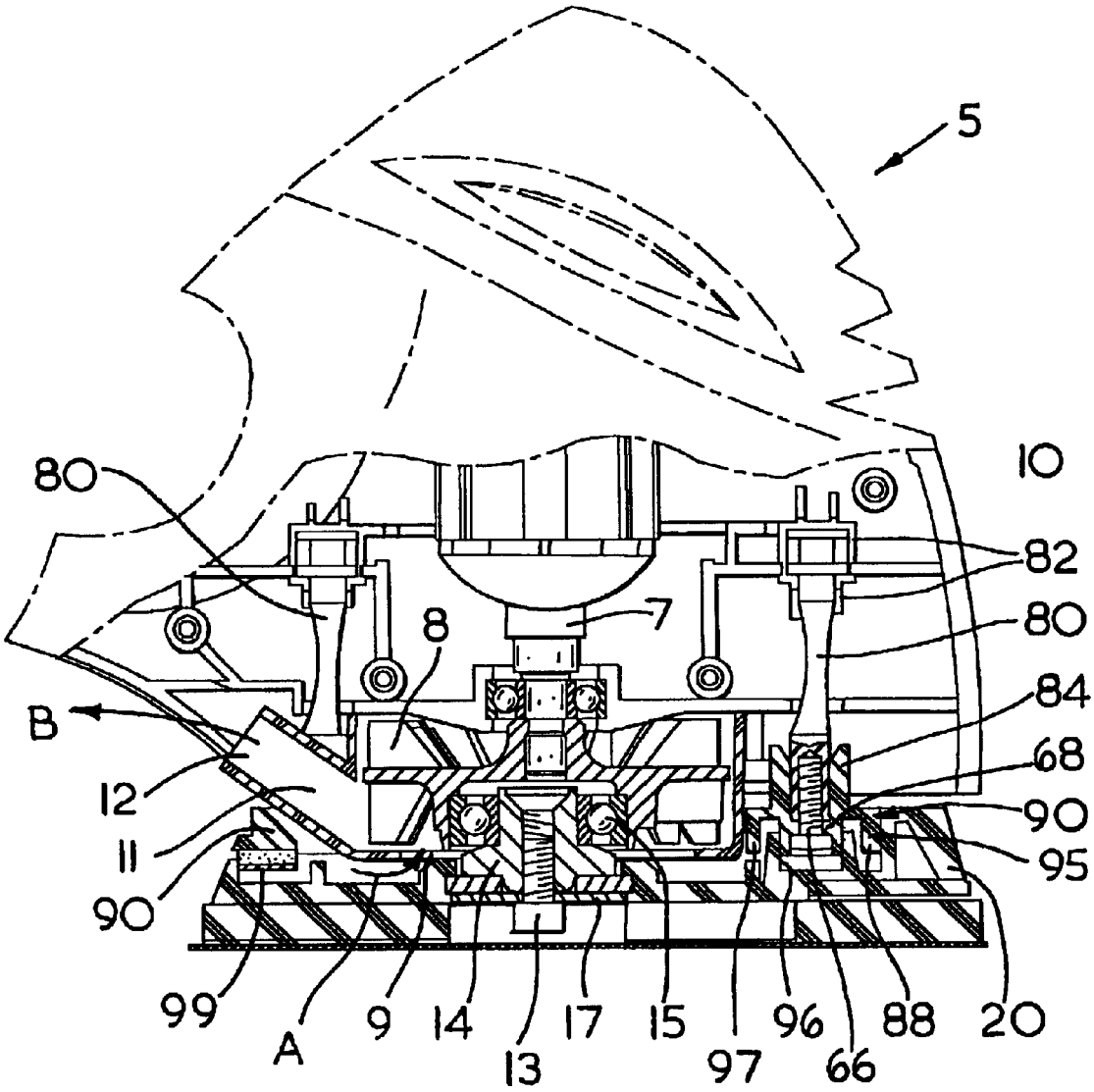
FIG. 2 is a side view, partially in section, of the hand tool according to the present invention, showing the mounting platen of the hand tool with a second sanding platen, which is an orbital sanding shoe, attached.

FIG. 2 shows the drive unit 5 of the hand tool with a second sanding platen 20. The second sanding platen 20 is an orbital sanding platen and mounted in place of the random orbit platen of FIG. 1.

Figure 3:
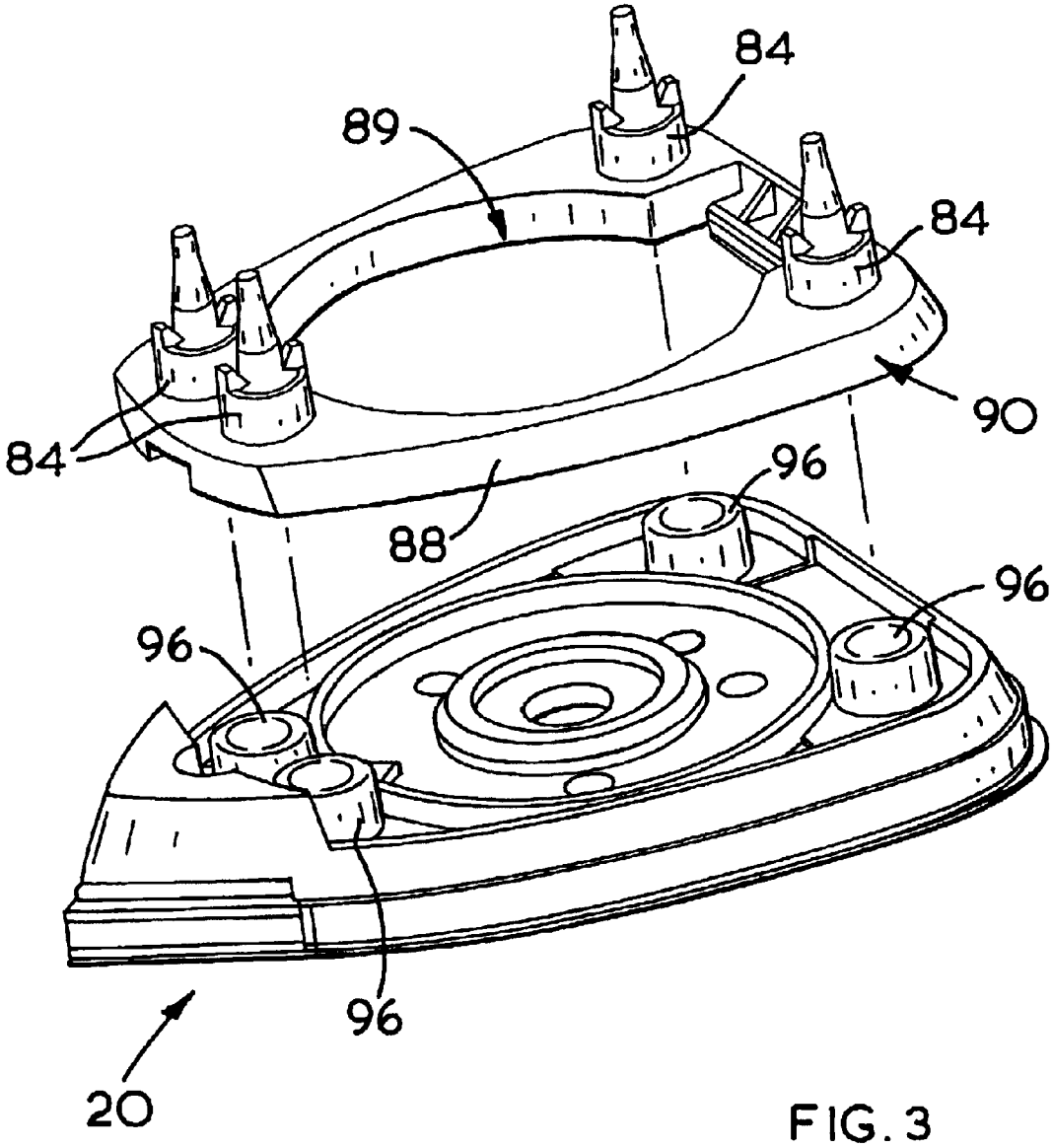
FIG. 3 is a perspective view of the mounting platen and sanding shoe of FIG. 2, showing the attachment side of the sanding shoe.
Figure 4:
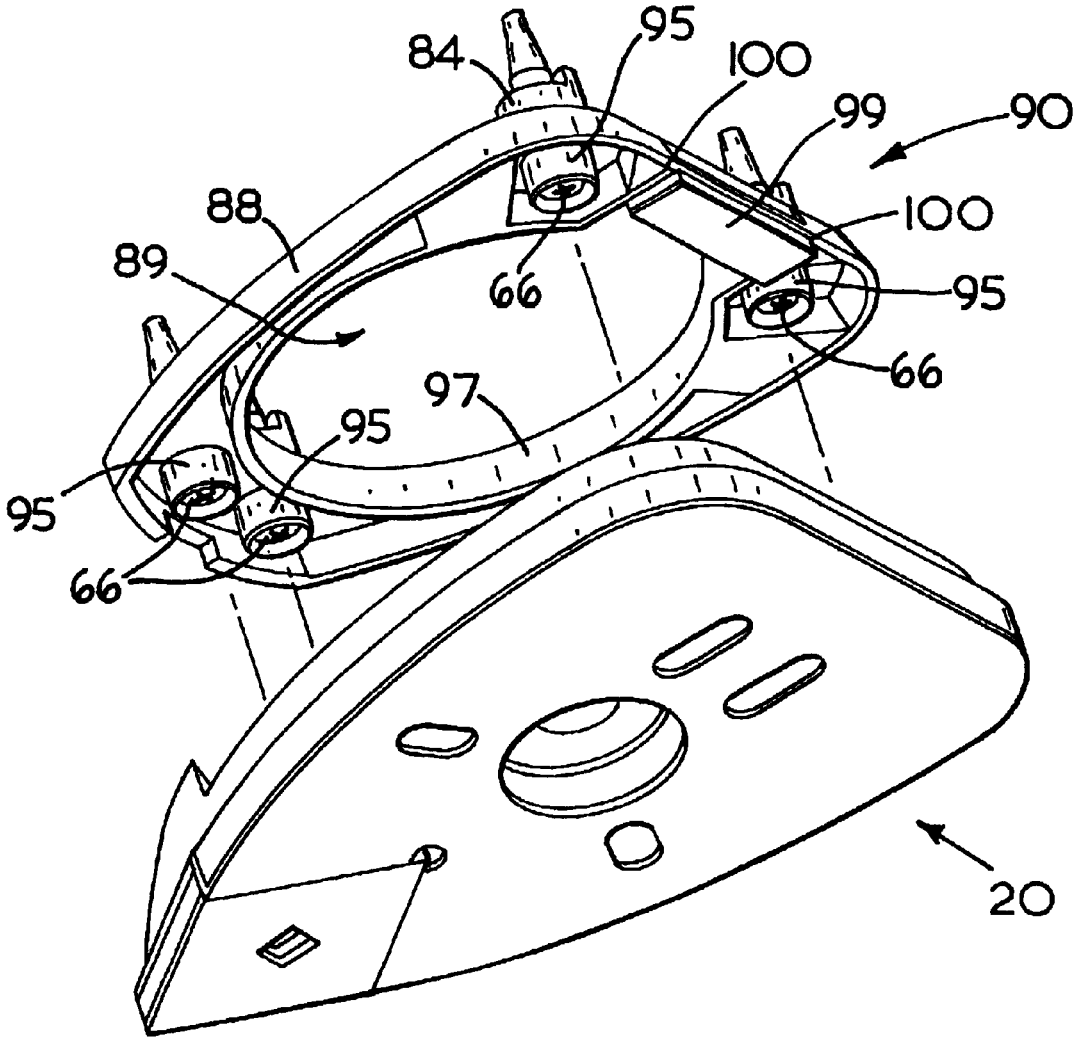
FIG. 4 is a perspective view of the mounting platen and sanding shoe of FIG. 2, showing the attachment side of the mounting platen.

FIGS. 3 and 4 show in more detail features of the mounting platen 90, which remains on the housing when the platens 20 and 21 are interchanged. From these Figures it can be seen that the mounting platen 90 is generally a blunt shoe shape, and is substantially flat, with a peripheral lip 88 extending downwards towards the sanding shoe 20. The large central aperture 89, allowing it to be positioned around the second drive shaft, radially distant therefrom, so there is no direct contact between the mounting platen 90 and the second drive shaft 14, can also be clearly seen in these Figures, as can the four hollow right cylindrical portions 84, integrally formed with the surface of the mounting platen 90, and projecting into the body of the housing 10. i.e. upwards as shown in the Figures. An inner lip 97 extends downwards around most of the central aperture 89, and joins to the outer peripheral lip 96 of the mounting platen 90 at two points 100 on one short side of the mounting platen 90.

In line with the upwardly directed projections 84, and projecting in the other direction, from the opposite surface of the mounting platen 90 are four hollow, generally cylindrical pin shaped coupling members 95. The pin-shaped coupling members 95 are also integrally formed with the mounting platen 90. The substantially flat mounting platen with its projecting portions 84 and 95 are preferably integrally injection moulded from polymeric material or diecast zinc.

The four coupling pins 95, provided on the opposite surface of the mounting platen 90 from the flexible legs 80, in corresponding positions, i.e. vertically aligned with the legs 80 as shown in FIGS. 3 and 4 have a dual function; the pins 95 secure the legs 80 in place, and couple with an orbital sanding head 20, in use, to prevent free rotation of that sanding head (FIGS. 2–4).

Each coupling pin 95 is an integrally formed part shaped as a hollow cylinder. The pin member 95 contains a radially directed flange 68 extending partially into the hollow of the pin member 95, to act as a stop member for a separate externally screw threaded headed bolt member 66 (see FIGS. 1 and 2). The externally screw threaded bolt member 66 passes through the hollow central pin member 95, and is shaped and sized to slide into the hollow pin member until its head abuts the internal stop flange 68, and then screw into inner hollow screw threaded cylindrical recesses at the mounting platen end of the flexible legs 80. By this screw threaded bolt member 66 the flexible legs 80 are therefore secured to the mounting platen.

As best seen in FIG. 2, each pin member 95 is located between part of the peripheral lip 88 and the inner lip 97 of the mounting platen 90. The pin member 95 of the coupling means 91 acts to couple to the orbital sanding shoe 20 to prevent its free rotation.

As shown in FIG. 2, when mounted on the drive unit 5, the orbital sanding shoe 20 is secured to the spindle of second drive shaft 14 by means of the same nut 13 and washer 17 used to secure the random orbit sanding platen 21 of FIG. 1. The orbital sanding shoe 20 is substantially flat, and is provided, on its upper major surface in the orientation shown in the Figure, with coupling means 96 shaped to co-operate with the coupling means 95 of the mounting platen 90. The coupling means 96 each comprise a hollow right-cylindrical stub, projecting upwards from the surface of the sanding shoe 20. The hollow right cylindrical projection 96 is shaped so that it provides a recess into which the pin member 95 of the mounting platen fits. One side of the cylindrical projection 96 on the sanding shoe 20 fits between the peripheral lip 88 of the mounting platen 90 and the outer surface of the pin member 95 of the mounting platen 90; and the opposite side of the cylindrical projection 96 on the sanding shoe 20 fits between the inner lip 97 of the mounting platen 90 and the opposite outer surface of the pin member 5 of the mounting platen 90.

By means of the co-operating coupling means 95 and 96, the sanding shoe 20 and mounting platen 90 are therefore securely located substantially to prevent relative movement between the mounting platen 90 and the sanding shoe 20 in a plane perpendicular to the axis of the bearing 15. Relative movement parallel to the axis of the bearing 15 is, of course, prevented by the nut 13 and washer 17 attachment.

In operation, when the motor is switched on and the drive shafts 7 and 14 turn, since the sanding shoe 20 is prevented from rotation relative to the mounting platen 90, and the mounting platen 90 is fixed relative to the housing 10 by means of legs 80, then free rotation of the sanding shoe 20 around the bearing 15 axis is prevented. The flexibility in the legs 80, however, allows the sanding platen 20 to follow the rotating motion of the eccentric spindle itself driven by the first drive shaft 7. Therefore the sanding shoe 20 is allowed to oscillate within a fixed orbit due to the flexibility of the legs 80.

In order to ensure that the sanding shoe 20 is always located the correct way round on the mounting platen 90, the coupling means 95 and 96 are non uniformly spaced over the surface of the mounting platen 90 and the sanding platen 20, those on one lateral side of the platens (the right as shown in FIGS. 3 and 4) being further apart from each other than those on the other lateral side of the platens (the left as shown in the Figures).

What is claimed is:

1. A powered oscillating hand tool comprising:

a housing;

a drive unit contained in the housing and having a first drive shaft;

a bearing mounted on the said first drive shaft which is located radially eccentrically relative to the first drive shaft, and which drives a second drive shaft;

a mounting platen permanently secured to the housing by means of at least one flexible leg; and first and second sanding platens interchangeably mountable on the second drive shaft, the first sanding platen being arranged for mounting on and for free rotation about the second drive shaft, and the second sanding platen being mountable on, but securable against free rotation about the second drive shaft;

wherein the mounting platen includes brake means for providing braking between the first sanding platen and the mounting platen, and coupling means for coupling with the second sanding platen to provide securement against free rotation of the second sanding platen about the second drive shaft.

2. The hand tool according to claim 1, wherein the brake means is provided on a surface of the mounting platen.

3. The hand tool according to claim 1, wherein the first sanding platen is mounted on the second drive shaft, and the brake means is provided by a brake pad mounted on the surface of the mounting platen facing the first sanding platen.

4. The hand tool according to claim 3, wherein the brake pad comprises an abrasion resistant contact layer mounted on a resilient support member, a surface of the first sanding platen facing the brake pad provides a reaction surface, whereby the resistant contact layer under compression provides a resultant load on the reaction surface.

5. The hand tool according to claim 4, wherein the resilient support member comprises one of a ring, a post and a plurality of posts and is formed from a resilient material.

6. The hand tool according to claim 4, wherein the abrasion resistant contact layer comprises polytetrafluoroethylene (PTFE).

7. The hand tool according to claim 1, wherein the coupling means of the mounting platen includes a peripheral lip of the mounting platen.

8. The hand tool according to claim 1, wherein the second sanding platen is mounted on the second drive shaft, and the coupling means of the mounting platen comprises a separate part provided on a surface of the mounting platen, and wherein co-operating coupling means are provided on the second sanding platen.

9. The hand tool according to claim 8, wherein at least one of the coupling means on the mounting platen or on the second sanding platen comprises a shaped part.

10. The hand tool according to claim 9, wherein at least one shaped part comprises one of a right cylindrical projection and a recess.

11. The hand tool according to claim 8, wherein at least one of the coupling means on the mounting platen and on the second sanding platen comprises a hollow recess.

12. The hand tool according to claim 11, wherein at least one of the coupling means on the other of the second sanding platen and the mounting platen comprises a central member, shaped and sized to fit into the hollow recess.

13. The hand tool according to claim 12, wherein the central member is generally pin shaped.

14. The hand tool according to claim 1, wherein the brake means is provided on a surface of the mounting platen and the first coupling means are provided on a surface of the mounting platen.

15. The hand tool according to claim 14, wherein the brake means and the coupling means of the mounting platen are provided on the same surface of the mounting platen, preferably on the surface facing the second sanding platen, when mounted.

16. The hand tool according to claim 1, wherein the mounting platen is located around at least part of one of the first and second drive shaft.

17. The hand tool according to claim 16, wherein the mounting platen is spaced laterally from the one of the first and second drive shaft.

18. A system to provide a random orbit and an orbital operating mode in an oscillating hand tool, the system comprising:

a tool having a housing and a driveshaft;

a mounting platen permanently secured to the housing, the mounting platen including brake means and coupling means thereon;

a first sanding platen mountable in a first engaged position for free rotation about the drive shaft, the first sanding platen including a surface for engaging the brake means of the mounting platen; and a second sanding platen mountable in a second engaged position securable against free rotation relative to the drive shaft, the second sanding platen having coupling means for cooperating with the coupling means on the mounting platen;

wherein the first and second sanding platen are selectively and alternatively coupled to the tool for operation in the respective random orbital and orbital modes.

19. The system according to claim 18, wherein the brake means is in the form of a brake pad on a surface of the mounting platen.

20. The system according to claim 18, wherein the coupling means on the mounting platen comprises a shaped part on a surface of the mounting platen.

21. The system according to claim 20, wherein the brake pad and coupling means of the mounting platen are provided a common surface of the mounting platen.

22. An oscillating tool for operating in one of an orbital mode and a random orbital mode comprising:

a housing having a driveshaft;

a mounting platen permanently secured to the housing, the mounting platen comprising:

a brake pad having an abrasion resistant contact layer mounted on a resilient support member;

a coupling surface; and compliant members coupling the mounting platen to the housing;

a first sanding platen mountable in a first engaged position for free rotation about the drive shaft, the first sanding platen including a reaction surface for engaging the brake pad of the mounting platen whereby the abrasion resistant contact layer provides a stopping force onto the reaction surface when engaged; and a second sanding platen mountable in a second engaged position securable against free rotation relative to the drive shaft, the second sanding platen having coupling means for cooperating with the coupling surface on the mounting platen;

wherein the first and second sanding platen are selectively and alternatively coupled to the tool for operation in the respective random orbital and orbital modes.

* * * * *